United States Patent [19]

Gaia

[11] Patent Number: 4,498,068

[45] Date of Patent: Feb. 5, 1985

[54] MAGNETIC ARC EXTINGUISHED FUSIBLE ELEMENTS

[75] Inventor: Aldino J. Gaia, St. Louis, Mo.

[73] Assignee: McGraw-Edison Company, Rolling Meadows, Ill.

[21] Appl. No.: 448,959

[22] Filed: Dec. 13, 1982

[51] Int. Cl.[3] ..... H01H 85/04

[52] U.S. Cl. ..... 337/293; 337/161; 337/295

[58] Field of Search ..... 337/293, 295, 290, 159, 337/160, 161, 162

[56] References Cited

U.S. PATENT DOCUMENTS

| | | | |
|---|---|---|---|
| 1,227,752 | 5/1917 | Cole | 337/293 |
| 1,604,477 | 10/1926 | Ogle | 337/293 |
| 2,720,567 | 10/1955 | Detch | 337/295 |
| 3,479,630 | 11/1969 | Kozacka | 337/295 |

*Primary Examiner*—Harold Broome

*Attorney, Agent, or Firm*—Charles W. MacKinnon; Jon Carl Gealow

[57] ABSTRACT

An electrical fuse wherein one or more portions of the fuse element are provided with two adjacent parallel weak spots separated by dielectric material or air gap, and arranged such that the direction of current flow in one of the adjacent weak spots is opposite that in the other adjacent weak spot, such that a magnetic field is generated which produces a separating force between the two weak spots. Arcs formed during the fusing of the weak spots are forced apart by the generated magnetic field thus increasing the arcs path lengths which increases arc voltage thereby forcing arc current to zero.

12 Claims, 7 Drawing Figures

MAGNETIC ARC EXTINGUISHED FUSIBLE ELEMENTS

BACKGROUND OF THE INVENTION

This invention relates to improvements in protective devices for electric circuits and more particularly to an improvement in electric fuses.

The fusible elements of many electric fuses have at least one portion with a reduced cross section known as a weak spot or fusible section. The weak spots of a fusible element account for the greatest part of the electrical resistance of the element. Because the weak spot presents the greatest resistance, the heat buildup under conditions of overcurrent is greatest and most rapid in this portion of the fusible element. This rapid heat buildup causes the weak spot to fuse or melt under overcurrent conditions. As the material in the weak spot fuses, an arc forms. This arc continues to conduct current.

It is known in the art to use a magnetic field to accelerate arc extinction. This can be accomplished because as the arc continues conducting, the electric current will interact with a magnetic field which produces a force on the arc causing it to move, thus, rapidly increasing the arc length. As the arc length increases, the arc voltage quickly rises until it exceeds the system voltage. At such time as the arc voltage exceeds the system voltage, the arc current begins to decrease. Only when the arc current reaches zero is the arc actually extinguished. Thus, it can be seen that a magnetic field which causes the arc length to increase rapidly can quickly bring the arc current to zero and thereby extinguish the arc in a much shorter time.

Prior art fuses have been suggested which utilize magnetics in some form to assist in clearing. These include, for example, the fuse of U.S. Pat. No. 2,734,110 issued to Jacobs, on Feb. 7, 1956, which uses a magnetic field concentrated adjacent to the weak spot for causing the products of arcing resulting from the fusing of the weak spot to be moved outwardly through a set of orifices. U.S. Pat. No. 1,441,550 issued to Weston, on Jan. 9, 1923, discloses the use of a fuse element with two or more weak spots arranged in series and configured such that the magnetic field created by the current flow in the fuse during clearing causes the portion of the fuse located between the weak spots to be displaced sidewise. U.S. Pat. No. 3,275,771 issued to Salzer, on Sept. 27, 1966, discloses the use of parallel fuse elements with a gas-evolving insulating material disposed between them. The current flow in each of the two elements is parallel and codirectional whereby the electromagnetic forces between the parallel arcs formed by the fusing of the weak links causes the arcs to be pulled into the gas-evolving insulating material to quench the arcs. U.S. Pat. No. 4,063,297 issued to Pullen, Jr., on Dec. 13, 1977, discloses the use of a tensioned spring element in conjunction with a horn gap in which magnetic forces are used to aid in arc extinguishing U.S. Pat. No. 659,671 issued to Hewlett, on Oct. 16, 1910, discloses the use of an electromagnet in combination with a fuse element and a pair of arcing tips to extinguish the arc resulting from an overcurrent. U.S. Pat. No. 685,766 issued to Jones, on Nov. 5, 1901, discloses the use of an electromagnet in series with the fuse element to assist in extinguishing the arc.

While the fuses described in the prior art patents discussed heretofore all use magnetics in some form to extinguish the arc created in the clearing of the fuse, many require external magnetic fields or the dropping away of one or more sections of the fuse structure by gravity or spring or other force assist, causing the fuse structure to be complex and more costly.

SUMMARY OF THE INVENTION

It is therefore an object of the present invention to provide an improved fuse element having inherent magnetic arc lengthening capability.

It is a further object of this invention to provide a simple fuse means having the feature of rapid arc extinction.

It is a still further object of this invention to provide magnetically assisted arc extinguishing action in a fusible element resulting from the geometric features of the fusible element itself.

Briefly, the fusible device of the present invention provides a novel configuration wherein one or more portions of the fuse element are provided with two adjacent parallel weak spots arranged such that the direction of current flow in one of the adjacent weak spots is opposite that in the other adjacent weak spot. The pair of parallel weak spots are separated by a dielectric material or an air gap. Opposite current flow in the two parallel weak spots generates a magnetic field which produces a separating force between the two weak spots. Arcs resulting from the fusing of the weak spots due to an overcurrent are forced apart by the generated magnetic field. This increases the arc path lengths which increases arc voltage, forcing the arc current to zero, thereby extinguishing the arc. Thus, the present invention provides an improved means of electromagnetic arc extinction.

BRIEF DESCRIPTION OF THE DRAWINGS

In the drawings;

FIG. 4*b* is a side view of the first alternative embodiment of the fusible element formed from the blank of FIG. 4*a.

DETAILED DESCRIPTION OF THE INVENTION

Figure 1A:
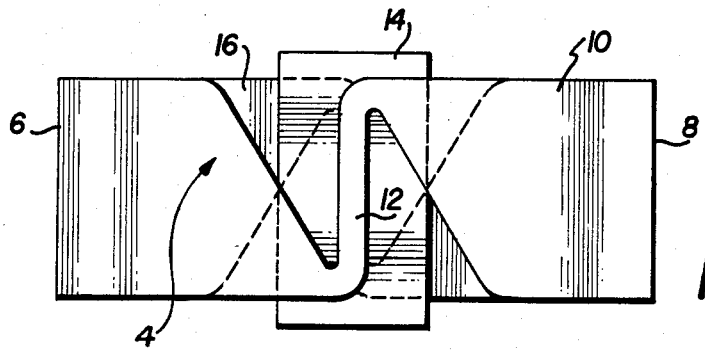
FIG. 1*a* is a side view of a preferred embodiment of the fusible element of the present invention.
Figure 1B:
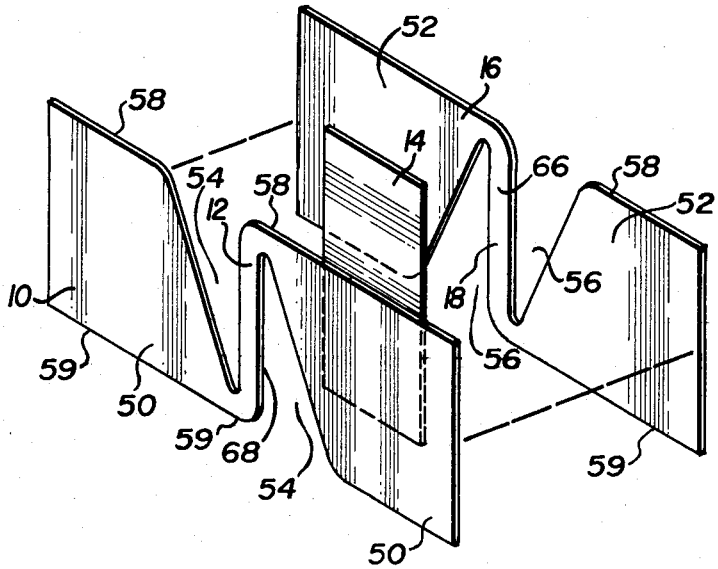
FIG. 1*b* is an expanded perspective view of the embodiment of the fusible element of FIG. 1*a;*
Figure 2:
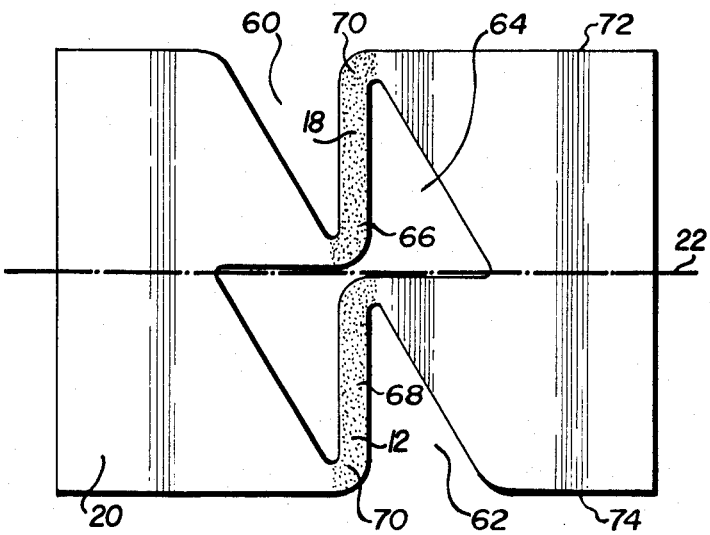
FIG. 2 is a side view of a blank alternatively used in forming the fusible element of FIG. 1*a;*

Referring now to the drawings and particularly to FIGS. 1*a* and 1*b* showing a preferred embodiment 4 of the fuse element according to the invention, fuse strips or subelements 10, 16 are each individually formed from strips of fusible materials having two generally V-shaped notches 54, 56 cut in opposite edges 58, 59, respectively, to form transverse weak spots 12, 18, respectively. Full width portions 50, 52 of fuse strips 10, 16 are joined together with weak spots 12, 18, respectively, which are positioned adjacent, parallel and separated from each other by a thin insulator 14. As an alternative to insulator 14, the inside facing surfaces 66, 68 of one or both weak spots 12, 18 may be coated with a surface applied dielectric 70 as shown in FIG. 2, or may be separated by air.

The joined fuse strips 10, 16 are provided with terminals 6, 8 to permit mounting of the joined strips in a fuse housing (not shown). Means for mounting strips 10, 16 in the fuse housing are well known in the art. For example, terminals 6, 8 may be soldered onto ferrule-like metal caps. Alternatively, holes may be provided in strips 10, 16 at terminals 6, 8 for screw mounting.

Figure 3:
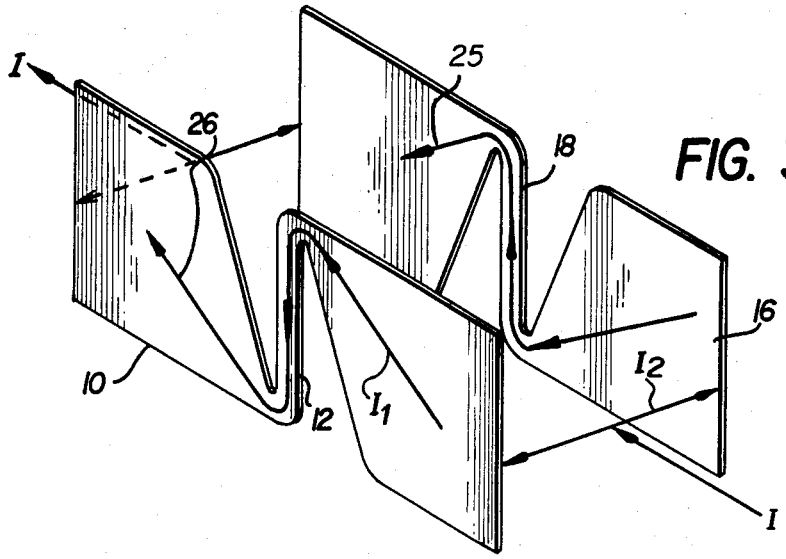
FIG. 3 is an expanded perspective view of the fusible element of FIG. 1*a* showing diagrammatically the flow of current therethrough.

The rapid arc extinguishing action of the present invention can be best understood by reference to FIG. 3. Fuse strips 10, 16 are substantially equal in resistance. Consequently, current I flowing through the protected circuit divides in substantially equal magnitudes between fuse strips 10, 16 as indicated by the symbolic flow lines 25, 26. As shown, the direction of current flow 26 in transverse weak spot 12 is opposite the direction of current flow 25 in transverse weak spot 18. It is well known that the magnetic force of repulsion between two conductors with opposed balanced current flow is equal to $$(K\mu I_1 I_2 L)/r$$

wherein

- $\mu$ is the magnetic permeability of the surrounding medium,
- $I_1$ is the current flowing in the first conductor,
- $I_2$ is the current flowing in the second conductor,
- L is the length over which the conductors are parallel,
- r is the distance between the parallel sections of the conductors, and
- K is a constant.

Thus, for fuse element 4 depicted in FIG. 3, the force acting on arcs formed in fused weak spots 12, 18 is directly proportional to the product of the magnitude of the overcurrent in each weak spot 12, 18 and inversely proportional to their separation. In overcurrent conditions in which the overcurrent is small, the arc lengthening force is relatively small, but so is the arc-sustaining current, and a smaller arc lengthening force is sufficient. Under heavy overcurrent conditions, the force pushing the arcs apart is relatively strong and will quickly increase the arc length and therefore increase the arc voltage to assist in rapidly bringing the arc current to zero, thereby extinguishing the arc. Ideally, insulator 14 should have as high a value of magnetic permeability as practical to magnify the magnetic force and, further, should be as thin as allowed by the potential level of the circuit to minimize separation distance.

The form of the fuse element of the present invention is characterized by its bifurcated construction, i.e. branched paths, and by its bifacial nature in that the two strips 10, 16 are arranged in unlike fashion, i.e. the joined strips present dissimilar faces, even though their basic shape is the same. Thus, the functional basis of the present invention is the use of bifacial means to provide adjacent parallel, opposed current flow in a bifurcated fuse element.

FIG. 2 depicts an alternative construction of the fuse element of the present invention. Fuse material blank or strip 20 is provided with two disjointed transverse weak spots 12, 18 by means of two generally V-shaped cutouts 60,62 at opposite edges 72, 74 of strip 20 and by a double, opposed V-shaped punchout 64 along centerline 2. Folding strip 20 along centerline 22 creates fuse element 4 as shown in FIG. 1*a*. As an alternative to insulator 14 the inside facing surfaces 66,68 of weak-spots 12, 18 are coated with a surface applied dielectric 70.

Figure 4A:
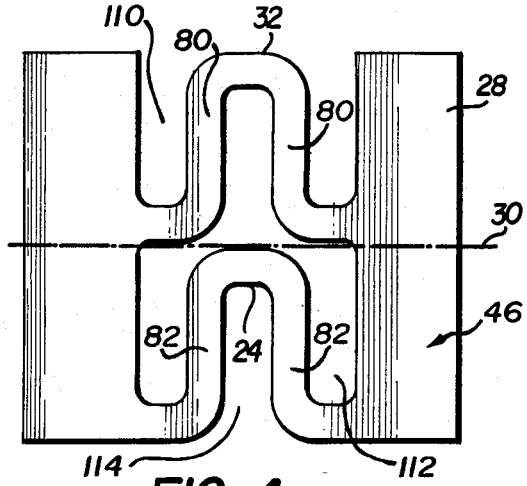
FIG. 4*a* is a side view of a blank used in forming a first alternative embodiment of the fusible element.
Figure 4B:
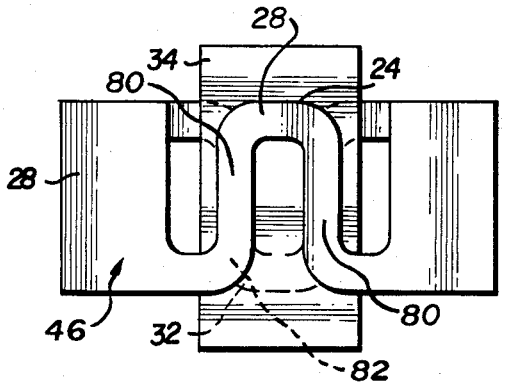

An alternative fuse element embodiment 46 of the present invention is shown in FIGS. 4*a* and 4*b*. FIG. 4*a* depicts a preferred fuse blank 28 of alternative fuse embodiment 46 of FIG. 4*b*. Fuse blank or double strip 28 is provided with two generally U-shaped weak spots 24, 32 by means of cutouts or punchouts 110, 112, 114. By folding strip 28 along centerline 30 and inserting insulator 34 between weak spots 24, 32, the alternative fuse element 46 depicted in FIG. 4*b* is obtained. In fuse element 46 two transverse sections 80,82 of U-shaped weak spots 24,32, respectively provide parallel, opposed current flow paths. Alternatively, the bifacial fuse element depicted in FIG. 4*b* could likewise be constructed from two separate strips each having a U-shaped weak spot, the strips being joined together as described hereinabove with respect to the embodiment shown in FIG. 1*a*.

Figure 5:
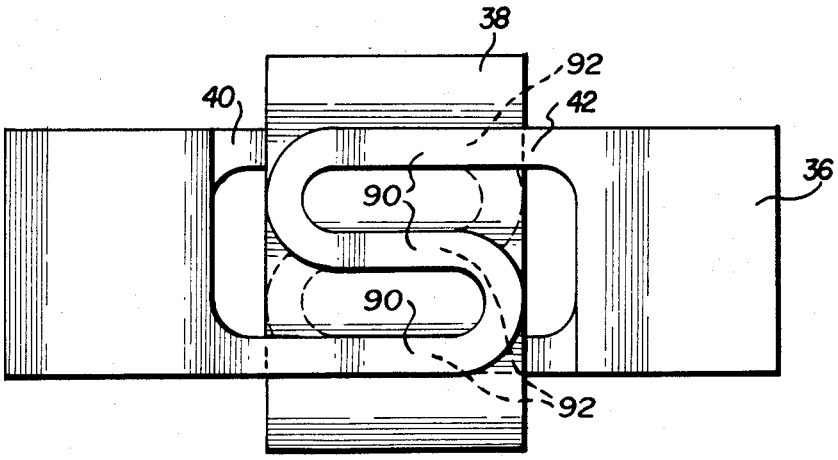
* and FIG. 5 is a side view of a second alternative embodiment of the fusible element.

A further alternative fuse element embodiment 36 of the present invention is depicted in FIG. 5. Fuse element 36 comprises generally S-shaped weak spots 40 and 42 separated by insulator 38. The three longitudinal sections 90, 92, of weak spots 40, 42 provide for adjacent, parallel, opposed current flow. The construction of fuse element 36 can be by either of the two general construction methods described hereinabove with respect to the preferred embodiment of FIG. 1*a*.

A fuse element comprising a plurality of weak spots as disclosed herein is used for high-voltage circuit protection. The sets of weak spots may also be arranged in series along the fusible element.

While the several forms of magnetic rapid arc extinguishing fuses disclosed herein constitute preferred embodiments, it should be understood that modifications thereof are within the scope and spirit of the invention disclosed and claimed.

I claim:

1. A fuse element having electro-magnetic arc extinguishing characteristics, including in combination: bifurcated electrically conductive means; and first and second terminal means at opposite ends, respectively, of said bifurcated electrically conductive means for connecting said bifurcated electrically conductive means into an electrical circuit;

said bifurcated electrically conductive means comprising, between said first and second terminal means, at least one first weak spot and at least one second weak spot, said weak spots comprising fusible material and at least portions of said first and second weak spots being disposed substantially parallel to each other;

said first and second weak spots being arranged such that current flow, between said first and second terminal means, in said parallel portion of one of said first and second weak spots is opposite in direction to current flow in said parallel portion of the other of said first and second weak spots; whereby a magnetic force of repulsion is generated between said first and second weak spots, thereby to lengthen arcs formed in said weak spots by an overcurrent passing therethrough.

2. A fuse element of claim 1 further including electrical insulating means disposed between said first and second weak spots.

3. A fuse as claimed in claim 2 wherein said insulating means comprises a thin insulator.

4. A fuse as claimed in claim 2 wherein said insulating means includes an air gap.

5. The fuse element as claimed in claim 2 wherein said bifurcated electrically conductive means include first and second strips of fusible material, said first weak spot being integral with said first strip and said second weak spot being integral with said second strip.

6. A fuse element as claimed in claim 2 wherein said first and second weak spots are generally U-shaped.

7. A fuse element as claimed in claim 2 wherein said first and second weak spots are generally S-shaped.

8. A fuse element having first and second fusible strips each of said strips having a weak spot, at least a portion of said first strip being juxtaposed with at least a portion of said second strip, each of said weak spots of said first and second fusible strips including a first section; respectively; said first sections of said weak spots being in close proximity to each other and in parallel relation with respect thereto, and insulating means disposed between said first and second parallel sections, said weak spots being arranged such that current flowing through said fuse element flows through said first parallel section in a direction opposite the current flow through said second parallel section, whereby a magnetic force of repulsion is generated between said parallel sections of said weak spots to thereby lengthen arcs formed in said weak spots by an overcurrent passing therethrough.

9. A fuse element as claimed in claim 8 wherein said insulating means includes an air gap.

10. A fuse element as claimed in claim 8 wherein said insulating means comprises a thin insulator.

11. A fuse element as claimed in claim 8 wherein said weak spots are generally U-shaped.

12. A fuse element as claimed in claim 8 wherein said weak spots are generally S-shaped.

* * * * *

UNITED STATES PATENT AND TRADEMARK OFFICE

CERTIFICATE OF CORRECTION

PATENT NO. : 4,498,068

DATED : February 5, 1985

INVENTOR(S) : Aldino J. Gaia

It is certified that error appears in the above-identified patent and that said Letters Patent is hereby corrected as shown below:

On the title page;
TITLE: change the word "EXTINGUISHED" in the title to --EXTINGUISHING--

Claim 8, column 6, line 1: after the word "thereto" add --thereby to form first and second parallel sections--

Signed and Sealed this

*Sixth* Day of *August 1985*

[SEAL]

*Attest:*

DONALD J. QUIGG

*Attesting Officer*

*Acting Commissioner of Patents and Trademarks*